US005345868A

United States Patent [19]

Baker

[11] Patent Number: 5,345,868

[45] Date of Patent: Sep. 13, 1994

[54] PRINTING PLATE MOUNTING SUPPORT AND METHOD

[76] Inventor: A. Leroy Baker, Burlington, N.C.

[21] Appl. No.: 71,101

[22] Filed: Jun. 4, 1993

[51] Int. Cl.[5] ..... B41F 1/28

[52] U.S. Cl. ..... 101/415.1; 101/481; 101/DIG. 36

[58] Field of Search ..... 101/401.1, 415.1, DIG. 36, 101/481

[56] References Cited

U.S. PATENT DOCUMENTS

| | | | |
|---|---|---|---|
| 2,711,691 | 6/1955 | Leavens, Jr. | 101/216 |
| 3,160,096 | 12/1964 | Norton | 101/DIG. 36 |
| 3,390,633 | 7/1968 | Boughton | 101/401 |
| 3,577,856 | 5/1971 | Updegraff | 33/184 |
| 3,616,055 | 10/1971 | Mages | 156/384 |
| 3,841,217 | 10/1974 | Hodges | 101/DIG. 36 |
| 3,983,808 | 10/1976 | Jackson | 101/401 |
| 4,408,530 | 10/1983 | Yano et al. | 101/415 |
| 4,449,452 | 5/1984 | Mansell | 101/382 |
| 4,467,722 | 8/1984 | Klingelhoefer | 101/415.1 |
| 4,473,007 | 9/1984 | Colineau | 101/DIG. 36 |
| 4,611,539 | 9/1986 | Ireton | 101/DIG. 36 |
| 4,628,815 | 12/1968 | Van Kanegan | 101/DIG. 36 |
| 4,679,502 | 7/1987 | Jesehke | 101/415.1 |
| 4,705,590 | 11/1987 | Vandenberg | 156/447 |
| 4,727,806 | 3/1988 | Green, Sr. | 101/415.1 |
| 4,735,663 | 4/1988 | Hasegawa | 156/64 |
| 4,750,248 | 6/1988 | Brown | 29/51 |
| 4,862,800 | 9/1989 | Wieland | 101/DIG. 36 |
| 4,925,506 | 5/1990 | Baker | 156/64 |
| 5,052,120 | 10/1991 | Lubberts | 101/DIG. 36 |

FOREIGN PATENT DOCUMENTS

| | | | |
|---|---|---|---|
| 0015471 | 9/1980 | European Pat. Off. | 101/DIG. 36 |
| 015471 | 9/1980 | European Pat. Off. | 101/DIG. 36 |
| 0269816 | 6/1988 | European Pat. Off. | 101/DIG. 36 |
| 1940878 | 3/1970 | Fed. Rep. of Germany | 101/DIG. 36 |
| 3129418 | 3/1983 | Fed. Rep. of Germany | 101/DIG. 36 |
| 1150830 | 5/1969 | United Kingdom | 101/DIG. 36 |
| 2083411 | 3/1982 | United Kingdom | 101/DIG. 36 |

OTHER PUBLICATIONS

Star Labels, Inc. brochure *Mil-Mar Century Mil-Star* (undated).

*Primary Examiner*—Eugene H. Eickholt

[57] ABSTRACT

The invention presented provides a method of accurately, precisely mounting a flexographic printing plate on a printing press cylinder. A mounting device is utilized having a plate support which includes a pair of movable studs for maintaining the plate in proper position as it is mounted on the press cylinder. The flexographic plate is formed with a pair of removable alignment projections along its border which assist in the formation of precise apertures therein. During alignment, plate mounting studs are adjustably positioned on the support plate for reception by the apertures formed in the printing plate to accurately position the printing plate on the printing press cylinder.

8 Claims, 3 Drawing Sheets

PRINTING PLATE MOUNTING SUPPORT AND METHOD

BACKGROUND OF THE INVENTION

1. Field of the Invention

The invention herein pertains to devices for mounting flexible printing plates on press cylinders and particularly to mounting device support plates and methods.

2. Description of the Prior Art and Objectives of the Invention

Various printing plate mounting devices have been conceived and used in the past such as set forth in U.S. Pat. Nos. 4,925,506 and 4,705,590. These devices are useful in mounting previously prepared printing plates on press cylinders. A slideable support plate is shown in U.S. Pat. No. 4,925,506 whereby an adhesive tape is used to temporarily hold the printing plate onto the mounting device support plate while a transparent grid is utilized to insure correct alignment of the printing plate on the support. This method has proved useful but at times the grid can be misread or the printing plate can be moved from its desired position thus ultimately causing the printing plate to be incorrectly mounted on the press cylinder.

With the shortcomings and problems associated with prior art mounting devices and methods, the present invention was conceived and one of its objectives is to provide an improvement in a plate mounting device and method by presenting a support plate having mounting studs thereon which cooperatively engage apertures within the printing plate for positive alignment.

It is another objective of the present invention to provide an apparatus and method for forming a printing plate having apertures for the aforementioned cooperative engagement.

It is still another objective of the present invention to provide a method of mounting a printing plate on a mounting device support plate to insure correct alignment and attachment to the printing press cylinder.

Various other objectives and advantages of the present invention become apparent to those skilled in the art as a more detailed presentation is set forth below.

SUMMARY OF THE INVENTION

The invention herein pertains to the precise mounting of printing plates such as conventional flexographic printing plates on press cylinders. The invention provides an improved mounting device support plate having slideable support plate mounting studs thereon for cooperative engagement with pre-formed printing plate border apertures. The printing plate apertures are formed by first forming a conical alignment projection on the plate border during plate making and then removing the projections while utilizing the projections to center a hollow shanked drill bit which forms an aperture in the border around the projection. The apertured printing plate can then be correctly positioned on the mounting device support plate and then transferred to the press cylinder as conventional.

DESCRIPTION OF THE PREFERRED EMBODIMENT

Figure 1:
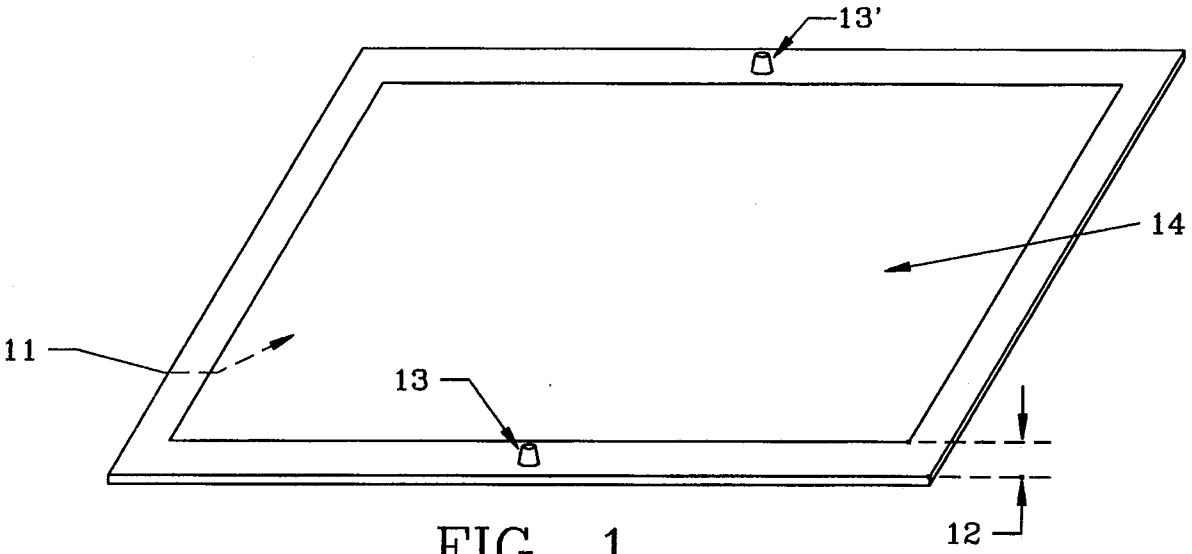
FIG. 1 shows a perspective view of a flexographic printing plate having alignment projections formed thereon.
Figure 2A:
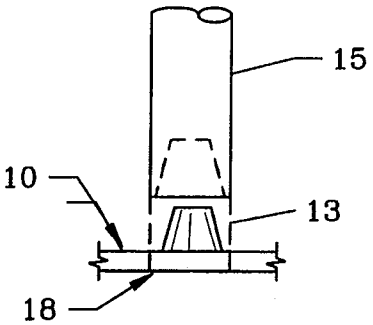
FIG. 2A pictures the drill bit of FIG. 2 prior to engagement with the alignment projection and before the aperture is created.

An example of the preferred printing plate of the invention prior to border aperture formation is shown in FIG. 1 whereby a pair of alignment projections are shown on each side, in the border area. In the method as used therewith, a conventional drill press "punches" (removes the alignment projections while forming apertures) in the printing plate border with a hollow shank drill bit as shown in FIG. 2A.

Figure 5:
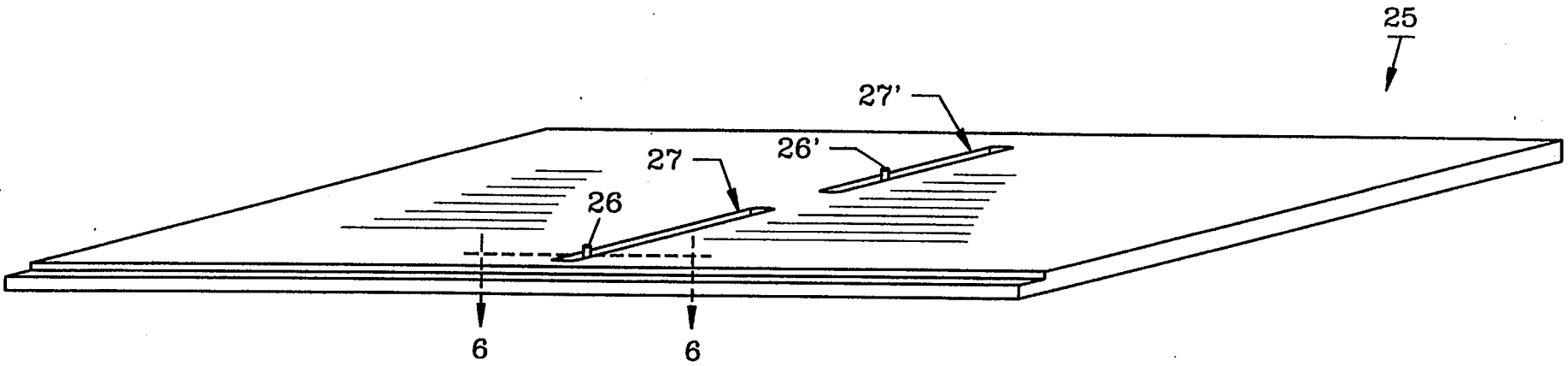
FIG. 5 demonstrates the mounting device support plate removed therefrom to better illustrate slideable plate mounting studs.
Figure 6:
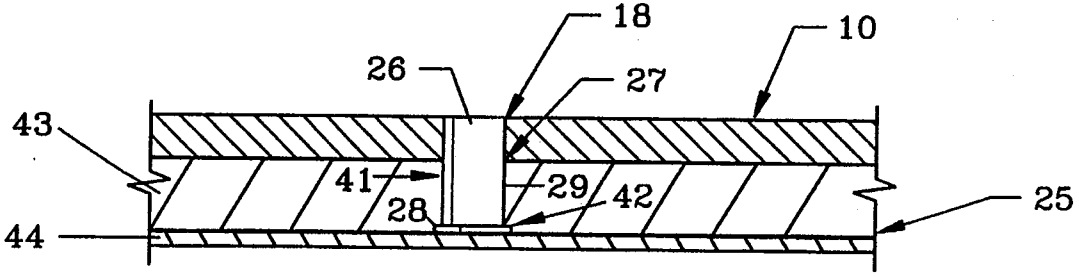
FIG. 6 shows a cross-sectional view of the support plate as shown in FIG. 5 along lines 6 and one mounting stud (not shown in cross section) extending through a flexographic printing plate (shown in cross section).

FIG. 5 shows a preferred embodiment of the mounting device support plate for receiving the apertured printing plate and provides a pair of cylindrically shaped slideable plate mounting studs which are located within slots as shown in FIG. 6. The laterally movable plate mounting studs include a wide head which is below the surface of the mounting plate and a longitudinal shaft which extends vertically above the top surface of the support plate for reception by the printing plate apertures.

DETAILED DESCRIPTION OF THE DRAWINGS AND OPERATION OF THE INVENTION

Figure 1A:
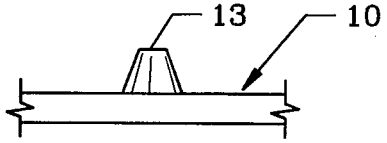
FIG. 1A illustrates a close up side view of a single alignment projection on the printing plate as seen in FIG. 1.

For a more complete understanding of the invention and the methods employed, turning now to the drawings, FIG. 1 demonstrates back 14 of a conventional polymeric flexographic printing plate 10 as having an ink receptive area 11 (not seen) on the front and a plain surrounding border 12. As would be understood, border 12 may vary in size as may ink receptive area 11, depending on the particular image or print size required. Alignment projections 13, 13' are formed on each side along border 12 of plate 10 as the plate is made by known methods and consist of conical configurations approximately one-eighth to three-sixteenth inches in height as shown enlarged in FIG. 1A. Alignment projection 13 is conically shaped and extends slightly above the surface of plate 10.

Figure 2:
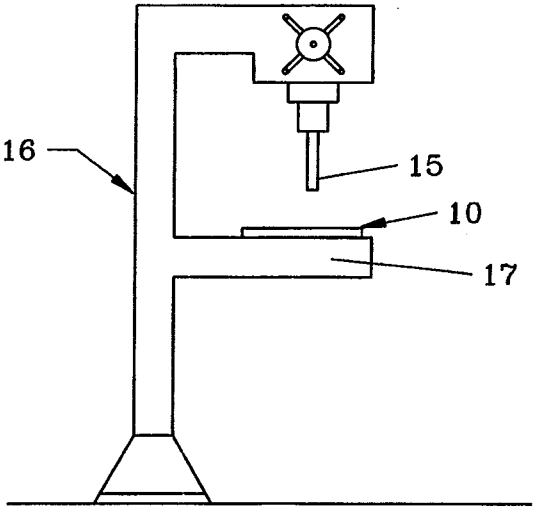
FIG. 2 demonstrates a conventional drill press with a hollow shank paper drill bit therein as used in the invention.

In order to prepare plate 10 of FIG. 1 for mounting on a press cylinder for printing, alignment projections 13, 13' are "punched" out as will hereinafter explained. Plate 10 is "punched" or drilled utilizing a conventional hollow shank paper drill bit 15 as seen in FIGS. 2 and 2A. Drill bit 15 is mounted in standard drill press 16 and plate 10 is positioned on drill press base 17 whereby drill bit 15 is then directly aligned vertically with projection 13 as shown in FIG. 2A. As further seen, the conical shape of projection 13 effects the alignment of drill bit 15 as conical projection 13 helps center hollow shank drill bit 15 thereon. By use of alignment projection 13, 13' aperture 18 as formed in plate 10 by the action of drill bit 15 are precisely located as better shown in FIG. 6. As would be understood, aperture 18 is formed as alignment projection 13 is removed by drill bit 15 and aperture 18' (not shown) is formed as alignment projection 13' is removed from plate 10 by drill bit 15 in a subsequent step.

Figure 3:
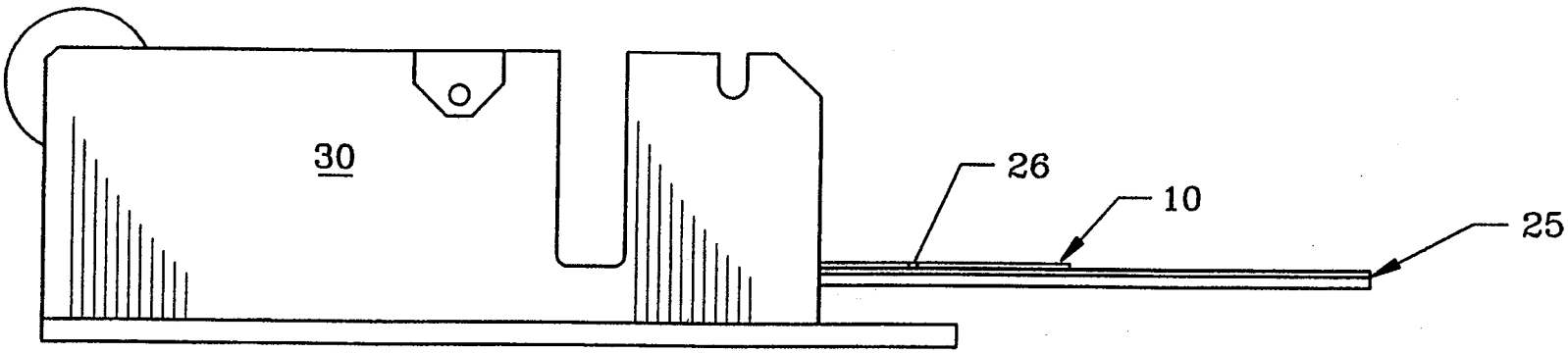
FIG. 3 depicts the "punched"flexographic printing plate positioned on the plate support of the mounting device.
Figure 4:
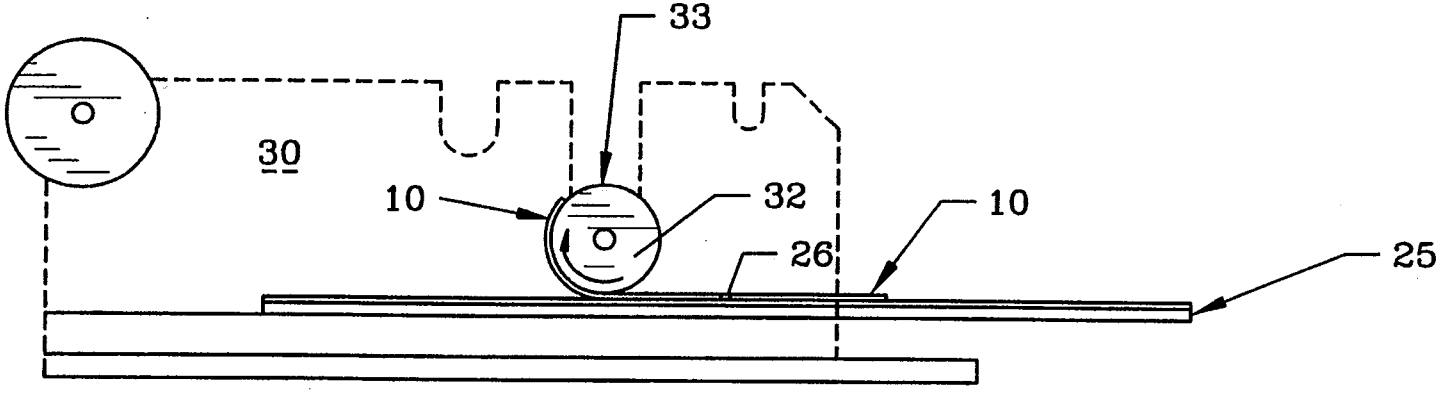
FIG. 4 illustrates the plate support with the printing press cylinder in contact with the printing plate.

Once plate 10 has been "punched" by drill bit 15, it is now ready for mounting on support plate 25 of mounting device 30. Mounting device 30 as seen in FIGS. 3 and 4 is a conventional flexographic plate mounting device as previously described in my prior U.S. Pat. No. 4,925,506. Mounting device 30 includes removable support plate 25 which includes a pair of laterally slideable plate mounting studs 26, 26' as shown in FIG. 5. Support plate 25 also includes a pair of lateral slots 27, 27'and as shown in FIG. 6, mounting stud 26 includes a head 28 and a longitudinal shaft portion 29 joined thereto which extends upwardly above support plate 25 and through printing plate 10. As would be understood, various size printing plates could be utilized and studs 26, 26' which are movable respectively within lateral slots 27, 27' allow apertures in printing plates of different spacings to be accurately and easily engaged. Lateral slot 27, as shown in FIG. 6, has upper portion 41, through which shaft portion 29 extends, and wider lower portion 42, in which head 28 is positioned. As can be seen, head 28 has a wider diameter than the width of slot upper portion 41 to prevent mounting stud 26 dislodging from slot 27. Support plate 25 may be formed of planar aluminum or other metals or materials and may include one or more layers for convenient construction. Bilayered support plate 25 is shown in FIG. 6 having thick upper layer 43 and thin lower layer 44. Support plate mounting studs 26, 26' may be formed of brass or other durable materials and may have a diameter of slightly less than one-quarter of an inch to properly fit within border apertures 18, 18' of plate 10 which are approximately one-quarter of an inch in diameter, although other aperture shapes and dimensions can be utilized.

As further shown in FIG. 3, plate 10 is positioned on mounting device support plate 25 with plate mounting studs 26, 26' in plate apertures 18, 18' (stud 26' and aperture 18' not seen in FIG. 3) and plate 10 is then directed into mounting device 30 as shown in FIG. 4. Next, press cylinder 32 is lowered into contact with plate 10. Press cylinder 32 has been provided with an outer adhesive surface 33 as conventional, to which plate 10 adheres. After contact with plate 10, by rotating press cylinder 32 counterclockwise, support plate 25 moves from right to left as shown in FIG. 4 and plate 10 enwraps cylinder 32 whereafter cylinder 32 with plate 10 can be removed from device 30 and placed on a printing press for printing purposes.

The illustrations and examples provided herein are for explanatory purposes and are not intended to limit the scope of the appended claims.

I claim:

1. In a mounting device for positioning a printing plate on a press cylinder, said mounting device having a movable support plate for receiving said printing plate, the improvement comprising: a support plate comprising a pair of planar layers, said layers affixed to each other one above the other, a support plate mounting stud, said upper layer defining a stud slot, said mounting stud positioned atop said lower layer and extending through said stud slot defined in said upper layer.

2. The mounting device of claim 1 wherein said support plate mounting stud extends vertically above said support plate.

3. The mounting device of claim 1 wherein said stud slot comprises an upper portion and a wider lower portion.

4. The mounting device of claim 3 wherein said mounting stud has a head, said head having a greater diameter than the width of said upper portion of said stud slot and said head positioned in said wider lower portion of said stud slot.

5. The mounting device of claim 3 wherein said mounting stud is laterally movable across said support plate within said stud slot.

6. In a mounting device for positioning a printing plate on a press cylinder, said mounting device having a movable support plate for receiving said printing plate, the improvement comprising:

a planar support plate comprising a pair of planar layers, said layers positioned one above the other and affixed to each other, the upper of said layers defining a pair of stud slots, said stud slots each having an upper portion coincidental with a wider lower portion, a pair of movable plate mounting studs, said plate mounting studs each comprising a longitudinal shaft portion and a head, said head wider than said shaft portion, said shaft portion positioned above and attached to said head, one each of said plate mounting studs positioned within one each of said stud slots, said head positioned within said wider lower portion, said head having a greater diameter than the width of said narrow portion, said plate mounting studs extending vertically above said slots for receiving a printing plate.

7. The mounting device of claim 6 wherein the upper of said layers is thicker than the lower of said layers.

8. The mounting device of claim 6 wherein said heads of said mounting studs are atop the lower of said layers.

* * * * *